United States Patent [19]

Kelley

[11] 4,300,529

[45] Nov. 17, 1981

[54] CLEANABLE WOODBURNING STOVE GRATE

[76] Inventor: Gordon D. Kelley, 735 Wade Hampton Blvd., Greenville, S.C. 29609

[21] Appl. No.: 141,337

[22] Filed: Apr. 18, 1980

[51] Int. Cl.[3] ..... F23H 13/00

[52] U.S. Cl. ..... 126/152 B; 126/154

[58] Field of Search ..... 26/165, 164, 154, 153, 26/152 R, 152 B, 242, 243, 244, 245, 167, 168

[56] References Cited

U.S. PATENT DOCUMENTS 2,092,112 9/1937 Fakult ..... 126/244

FOREIGN PATENT DOCUMENTS 331777 3/1914 Fed. Rep. of Germany ..... 126/154

85345 1/1921 Fed. Rep. of Germany ..... 126/154

*Primary Examiner*—James C. Yeung

*Attorney, Agent, or Firm*—Bailey, Dority & Flint

[57] ABSTRACT

An adjustable grate is illustrated for use in a woodburning stove and the like wherein pivoted linkage mechanism manually operable externally of the stove is capable of raising, lowering, and shaking the grate from above so as to facilitate unobstructed cleaning ashes from beneath the grate.

2 Claims, 5 Drawing Figures

CLEANABLE WOODBURNING STOVE GRATE

BACKGROUND OF THE INVENTION

Grates or similar apparatus for carrying burning coal, wood or other fuel within a stove or fireplace have been provided so as to be capable of being raised and lowered on a support carried therebeneath and operated externally of the device. As illustrated in U.S. Pat. Nos. 271,214, 682,778, 635,481, 1,461,443, and 3,213,846, the devices of the prior art possess disadvantages in that they are fairly complicated and mechanism is usually positioned beneath the grate which obstructs efforts on the part of operators to clean the ashes from beneath the grate. Cleaning ashes is an onerous task and those who have become use to automatic conveniences within the home are not inclined to undertake them if they can possibly be avoided. Due to increasing shortages of fuel of all types, however, and in the interest of economy, wood stoves and the like have become increasingly popular despite these disadvantages.

Accordingly it is an important object of this invention to facilitate cleaning the ashes from woodburning stoves, especially of the type having a combustion chamber within an external chamber to permit circulation of air such as in a "Buck" stove of the type illustrated herein and in U.S. Pat. No. 4,092,976.

Another important object of the invention is to provide a grate for use in a woodburning stove which is raisable and shakable in order to avoid the necessity of removing the grate during emptying the ashes, thus economizing on fuel by permitting live burning coals to remain in the grate thereby conserving energy.

SUMMARY OF THE INVENTION

It has been found that a grate construction for use in wood stoves and the like may be provided by employing a pivoted linkage means suspending the grate to permit raising and lowering of the grate by exterior manipulation of an operator so as to provide unobstructed cleaning of the area beneath the grate without necessity for removal thereof.

BRIEF DESCRIPTION OF THE DRAWINGS

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF THE PREFERRED EMBODIMENT

The drawings illustrate an improved grate construction for use in a combustion chamber of a woodburning stove and the like. A fireplace grate A has openings therein to allow ashes to fall therethrough within said combustion chamber. A suspension device B is carried by the grate on each end thereof. A support C has pivotal connection with the suspension means. Linkage means D are pivotally carried in the support means, and an operator E extends from the linkage means on one end within said combustion chamber outwardly externally of said combustion chamber for manual manipulation externally of the combustion chamber pivoting the linkage means within the combustion chamber. Thus, the grate may be raised to permit unobstructed cleaning of the ashes therebeneath.

Figure 1:
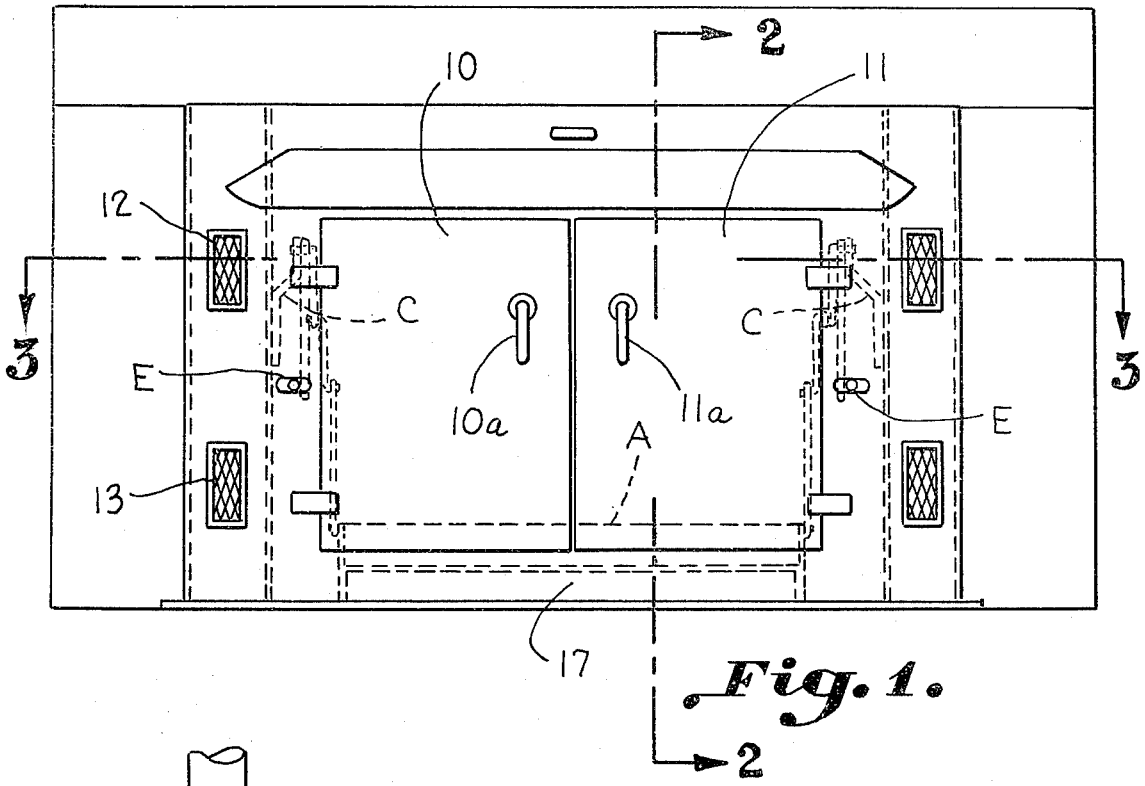
FIG. 1 is a front elevation illustrating a woodburning stove having a internally mounted combination chamber permitting the circulation of heated air there about equipped with a grate constructed in accordance with the present invention.
Figure 2:
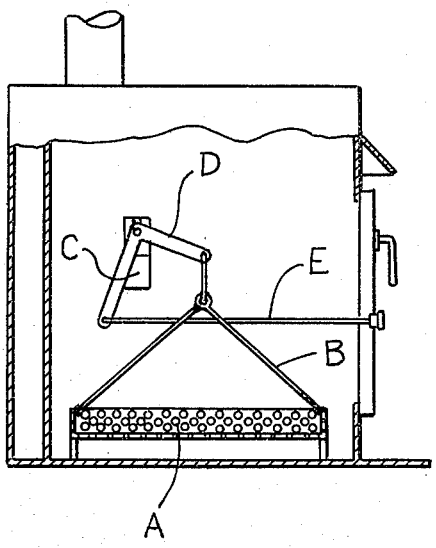
FIG. 2 is a sectional side elevation taken on line 2—2 in FIG. 1 illustrating linkage mechanism constructed in accordance with the invention for raising and lowering the grate within the stove.
Figure 3:
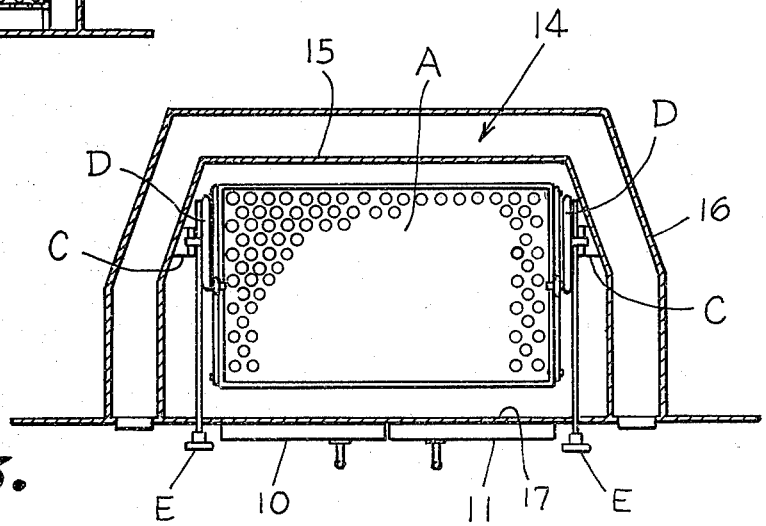
FIG. 3 is a sectional plan view taken on the line 3—3 in FIG. 1 further illustrating the grate construction.

Referring more particularly to FIGS. 1 and 3, a woodburning stove is illustrated having doors 10 and 11 hinged on opposite sides and opening from the middle having stove handles 10*a* and 11*a*. The doors have suitable side vents 12 and 13 on each side from which heated air flows from the area about the combustion chamber which may be referred to as the heat chamber broadly designated at 14. A combustion chamber is illustrated at 15 carried within the fireplace 16. It will be noted that the stove has a vertical front 17 beneath the doors 10 and 11 and define a part of the combustion chamber within which the grate A is disposed. The grate A is illustrated as including the front and rear sides 19 and 20 and ends 21 and 22. These members are perforated as illustrated. If desired, the perforated or foraminous characteristics may be imparted to the fireplace grate A through the use of spaced ribs which are aligned or open therebeneath. The grate forms a fire basket arrangement in that end members B are provided for serving as a suspension device and to provide pivotal connection with the linkage means D which are pivotally carried within the support C.

It will be noted that the linkage means D includes what is illustrated as a substantially upright link 23 in each linkage arrangement. An inwardly extending link 24 has rigid connection on one end with the member 23 and with a downwardly and inwardly extending link 25 on the other end. The link 25 has pivotal connection with the operator E. The operator E may be provided in the form of a circular rod 27 and a handle 28 on the free end thereof externally of the stove to facilitate manual manipulation by an operator externally of the stove. The support member C may be welded to the inside wall of the combustion chamber and is provided with a support portion 29 for carrying the linkage means D therein for pivotal movement.

Figure 4:
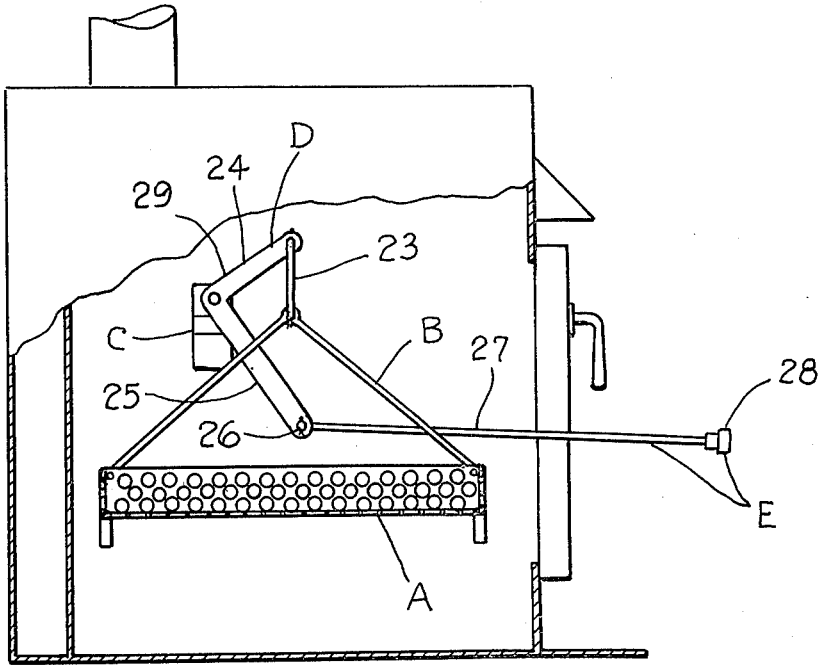
FIG. 4 is a side elevation similar to FIG. 2 further illustrating the grate construction but in raised position.
Figure 5:
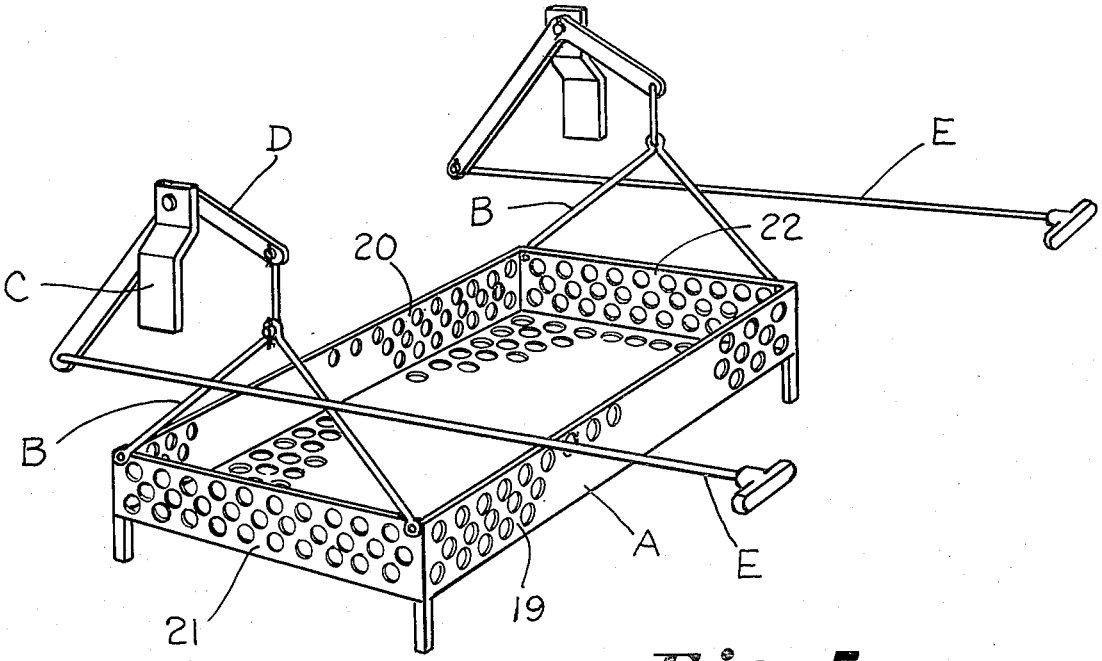
FIG. 5 is a perspective view illustrating a grate with suspension device at each end of a type suitable for devices constructed in accordance with the present invention.

It will thus be observed that a simple, manually operated means has been provided for raising and lowering a fireplace grate within a wood stove and the like. As illustrated, the grate may be lowered and retained in position by reason of movement of pivoting of the linkage beyond dead as illustrated in FIG. 4 wherein the grate is raised and the linkage is in position to permit a static condition of the grate during cleaning.

While a preferred embodiment of the invention has been described using specific terms, such description is for illustrative purposes only, and it is to be understood that changes and variations may be made without departing from the spirit or scope of the following claims.

What is claimed is:

1. For use in a woodburning stove and the like having an enclosure housing, a combustion chamber within said housing, an opening in said housing permitting direct access to said combustion chamber, an improved grate comprising:

a fuel burning grate having openings therein to allow ashes to fall therethrough within said combustion chamber;

a suspension device for said grate carried on each end thereof;

a support above said grate having pivotal connection with said suspension device;

linkage means pivotally carried in said support; and an operator extending from said linkage means on one end within said combustion chamber outwardly externally of said combustion chamber for manual manipulation externally of said combustion chamber pivoting said linkage means within said combustion chamber;

whereby said grate may be raised to permit unobstructed cleaning of the ashes therebeneath through said opening.

2. The structure set forth in claim 1 wherein said linkage means includes links carried in fixed relation to each other which may be pivoted beyond dead center to retain said grate in elevated position.

* * * * *